US009985386B1

(12) United States Patent
Matsumura et al.

(10) Patent No.: US 9,985,386 B1
(45) Date of Patent: May 29, 2018

(54) JUNCTION BOX ASSEMBLY WITH INTERNAL POWER CONNECTING FEATURE

(71) Applicant: Sumitomo Wiring Systems, Ltd., Yokkaichi-shi, Mie (JP)

(72) Inventors: Akihiro Maximilian Matsumura, Farmington Hills, MI (US); Charles Paul Depp, Ann Arbor, MI (US)

(73) Assignee: Sumitomo Wiring Systems, Ltd., Yokkaichi-shi, Mie (JP)

( * ) Notice: Subject to any disclaimer, the term of this patent is extended or adjusted under 35 U.S.C. 154(b) by 0 days. days.

(21) Appl. No.: 15/586,726

(22) Filed: May 4, 2017

(51) Int. Cl.

| | |
|---|---|
| ***H01R 13/502*** | (2006.01) |
| ***H01R 13/631*** | (2006.01) |
| ***H01R 25/16*** | (2006.01) |
| ***H01R 13/115*** | (2006.01) |
| ***H01R 4/30*** | (2006.01) |

(52) U.S. Cl.
CPC ..... *H01R 13/631* (2013.01); *H01R 4/30* (2013.01); *H01R 13/115* (2013.01); *H01R 13/502* (2013.01); *H01R 25/162* (2013.01)

(58) Field of Classification Search
CPC ..... H01R 13/447; H01R 13/5202; H01R 13/5219; H01R 13/5221; H01R 25/006; H01R 13/115; H01R 13/453; H01R 13/4538; H01R 13/518; H01R 13/6273; H01R 13/639; H01R 13/70; H01R 13/748; H01R 2105/00
See application file for complete search history.

(56) References Cited

U.S. PATENT DOCUMENTS

| | | | | |
|---|---|---|---|---|
| 5,285,011 | A * | 2/1994 | Shimochi | H01H 85/2035 174/138 F |
| 6,322,376 | B1 * | 11/2001 | Jetton | H01R 4/302 411/107 |
| 6,610,926 | B2 * | 8/2003 | Chiriku | H02G 3/18 174/59 |
| 6,870,097 | B2 * | 3/2005 | Oda | B60R 16/0238 174/50 |
| 6,929,489 | B2 * | 8/2005 | Asao | H01R 13/4538 439/140 |
| 2008/0149387 | A1 | 6/2008 | Oda | |

(Continued)

FOREIGN PATENT DOCUMENTS

JP 2016067090 A 4/2016

*Primary Examiner* — Truc Nguyen
(74) *Attorney, Agent, or Firm* — Dinsmore & Shohl LLP

(57) ABSTRACT

A junction box assembly configured to shield the eyelet terminal includes a power distribution box and a bottom housing. A bottom housing is configured to mate with an undersurface of the power distribution box. The eyelet terminal is disposed within the bottom housing. A first connection housing is disposed in the bottom housing. The first connection housing is configured to house a first bus bar having a female connector. The first bus bar is electrically connected to the eyelet terminal. A second connection housing is disposed on an undersurface of the power distribution box. A second bus bar is mounted within an inner space of the power distribution box and a connecting portion of the second bus bar is disposed within the second connection housing. The first connection housing engages the second connection housing within the bottom housing so as provide a shielded.

17 Claims, 9 Drawing Sheets

(56) References Cited

U.S. PATENT DOCUMENTS

| | | | | |
|---|---|---|---|---|
| 2012/0064741 | A1* | 3/2012 | Kawaguchi | H01R 9/226 439/76.2 |
| 2013/0034974 | A1* | 2/2013 | Akahori | H01R 9/2458 439/76.2 |
| 2014/0273554 | A1* | 9/2014 | Sugimoto | B60R 16/0238 439/76.2 |

* cited by examiner

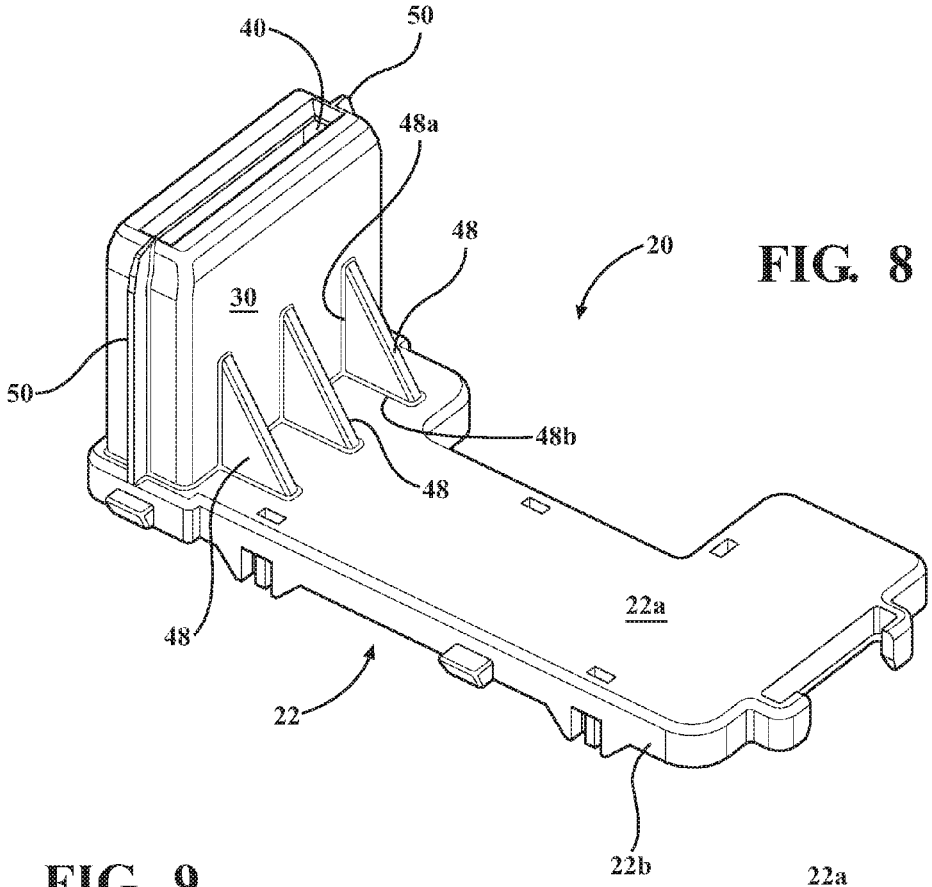
FIG. 8
FIG. 9
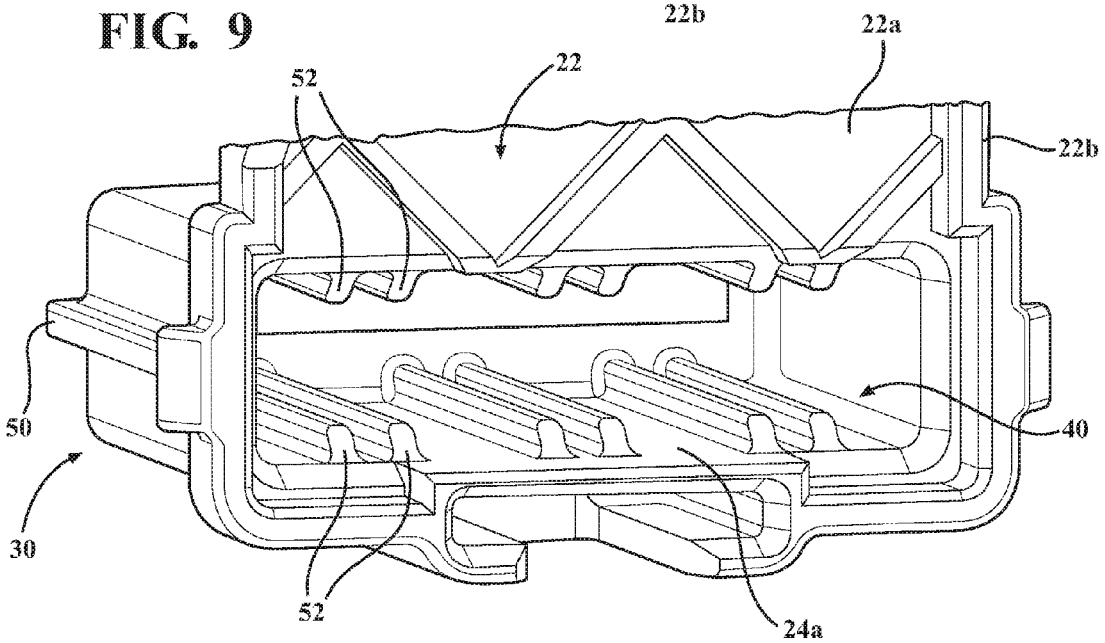

JUNCTION BOX ASSEMBLY WITH INTERNAL POWER CONNECTING FEATURE

TECHNICAL FIELD

The present specification generally relates to junction box assemblies, and more particularly electric junction box assemblies configured to house a power connection.

BACKGROUND

In general, electric junction box assemblies include a power distribution box for storing electric components configured to regulate power to various electric components. Generally stated, power is supplied to the power distribution box, wherein the power is regulated using commonly known components such as switches, relays, fuses, capacitors, resistors and the like. The regulated power is then supplied to selected electric components. The junction box assembly further includes a bottom housing, the bottom housing includes a space for routing power to the power distribution box.

An illustrative example of an electric junction box 100 of the prior art is shown in FIGS. 1-3. FIG. 1 is a perspective view showing the power distribution box 110 coupled to the bottom housing 120. The power distribution box 110 includes a top cover 110*a* which covers the electric components. FIG. 2 shows the top cover removed so as to expose an intermediate cover 110*b*. The eyelet terminal 130 is disposed on an outer edge of the power distribution box 110. An electric connection is made from the eyelet terminal 130 to the electric components within the power distribution box 110 by a bus bar or other known electric connection means. FIG. 3 shows how the eyelet terminal 130 is exposed in the packaging environment.

Accordingly, it remains desirable to have an electronic junction box assembly wherein the eyelet terminal may be shielded from damage.

SUMMARY

In one embodiment, a junction box assembly configured to shield the eyelet terminal is provided. The junction box assembly includes a housing having a first storage compartment disposed beneath a second storage compartment. The first storage compartment is configured to hold electric components. The electric components are configured to regulate power to various electric devices.

The second storage compartment is configured to hold components to route power to the first storage compartment. An eyelet terminal is disposed in the first storage component. A first connection housing is also disposed in the first storage compartment.

The first connection housing is configured to connect power from the eyelet terminal to the electric components within the first storage compartment. The first connection housing may include a base and a female connector housing. The base is configured to house a first bus bar. The female connector housing is configured to hold at least one female connector.

The junction box assembly further includes a second connection housing. The second connection housing is disposed on an undersurface of the second storage compartment. The second connection housing is configured to hold a second bus bar. The second bus bar is mounted within an inner space of the second storage compartment.

A connecting portion of the second bus bar is disposed within the second connection housing, wherein the female connector housing is configured to engage the second connection housing so as to couple the connecting portion of the second bus bar with the at least one female connector.

In one embodiment, the first storage compartment is a power distribution box and the second storage compartment is a bottom housing. The power distribution box may include a top cover, an intermediate cover and a bottom cover. The second connection housing is mounted to an undersurface of the bottom cover. The first connection housing is mounted within the bottom housing. The bottom housing may be releasably coupled to the underside of the power distribution box so as to form a single compartment.

In one embodiment of the junction box, the base includes a base cover and a base side wall. The base side wall may be a planar member generally bounding the peripheral edge of the base cover and generally orthogonal to the base cover so as to define a space for accommodating the first bus bar. The female connector housing may be generally cubic having a through-slot, wherein the through-slot is open on a proximal end to the space defined by the base.

In one embodiment, the first bus bar includes a base portion and a connector portion. The base portion is disposed within the space defined by the base. The connector portion is disposed in the proximal end of the through-slot of the female connector housing. The female connector is mounted to the connector portion of the first bus bar and is configured to receive the second bus bar. Wherein a portion of the second bus bar is housed within the second connection housing.

In one embodiment, the junction box assembly further includes. Accordingly, the junction box is configured to shield the eyelet terminal from the environment so as to prevent damage to the eyelet terminal, and help maintain the functional operation of the junction box assembly.

BRIEF DESCRIPTION OF THE DRAWINGS

The embodiments set forth in the drawings are illustrative and exemplary in nature and not intended to limit the subject matter defined by the claims. The following description of the illustrative embodiments can be understood when read in conjunction with the following drawings, where like structure is indicated with like reference numerals and in which:

FIG. 8 is an isolated view of a first connection housing according to one or more embodiments described and illustrated herein;

FIG. 9 a view of the female connector housing taken from the bottom;

DETAILED DESCRIPTION

Referring generally to the figures, embodiments of the present disclosure include a junction box assembly configured to shield the eyelet terminal. The eyelet terminal is disposed within the bottom housing and separated from the power distribution box. A first connection housing is electrically coupled to the eyelet terminal. A second connection housing is electrically coupled to electric components disposed within the junction box. The first and second connection housings each hold a bus bar and are configured to engage each other so as to form an electric connection between the eyelet terminal and the electric components within the power distribution box. The electric connection is made within the bottom housing. Accordingly, the eyelet terminal is shielded from the environment by the bottom housing.

As used herein the terms front and back are made in reference to the orientation of the related part when the retaining system is assembled, wherein the front refers to the portion of the part facing the other during assembly and the back refers to the portion of the part facing away from the front. The term top and bottom refer to the orientation of the part as shown in the figures.

Figure 4:
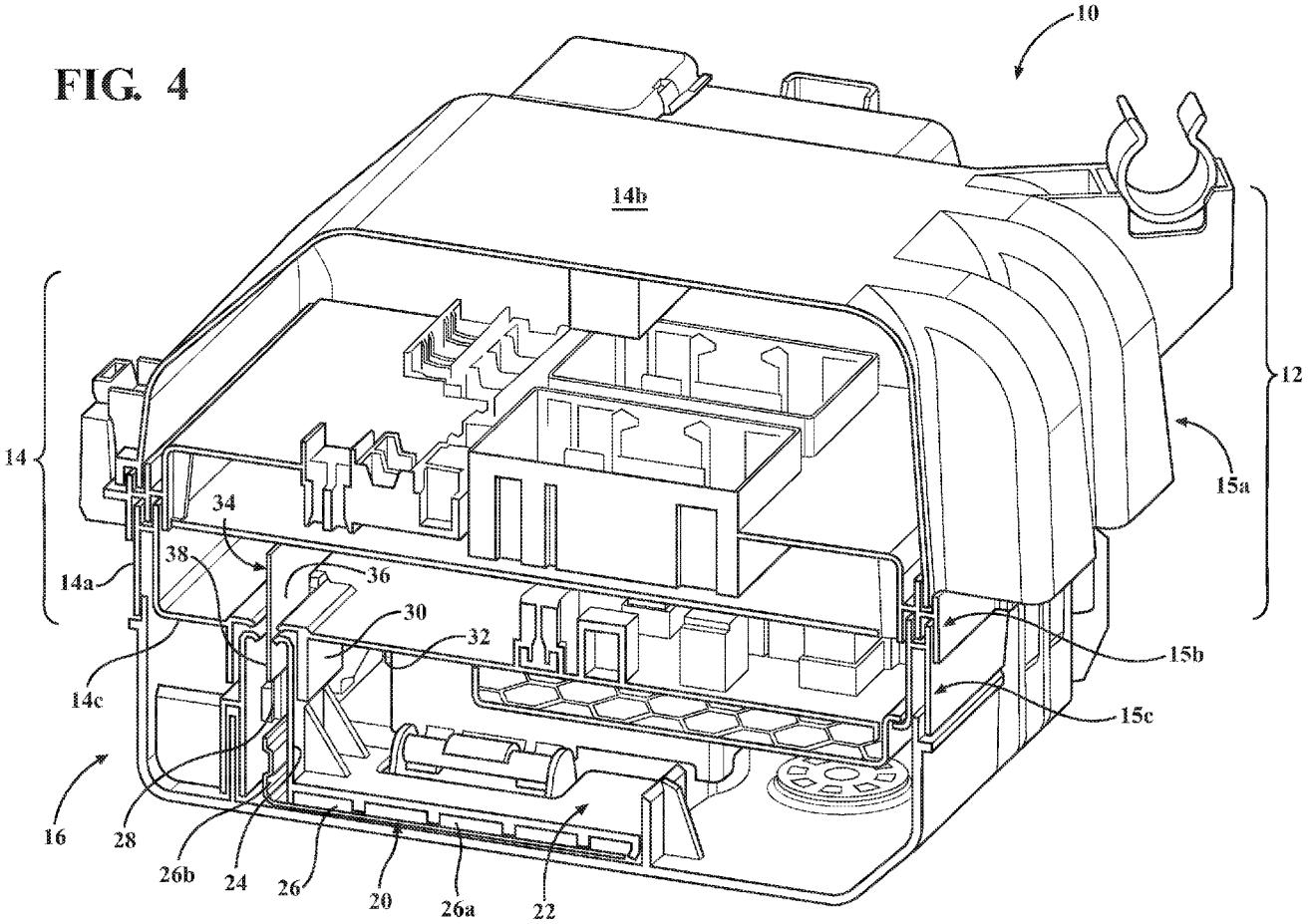
FIG. 4 is a cross-sectional view of a junction box assembly according to one or more embodiments described and illustrated herein.

With reference now to FIG. 4, an illustrative embodiment of a junction box assembly 10 is provided. The junction box assembly 10 includes housing 12 having a first storage compartment 14 disposed beneath a second storage compartment 16. The first storage compartment 14 is bound by an outer wall 14*a*, a top wall 14*b* and a bottom wall 14*c* and includes a plurality of inner walls dimensioned to hold electric components (not shown). The electric components are configured to regulate power to various electric devices (not shown).

The second storage compartment 16 is configured to hold components to route power to the first storage compartment 14. An eyelet terminal 18 (shown in FIG. 6) is disposed in the first storage compartment 14. A first connection housing 20 is also disposed in the first storage compartment 14. The first connection housing 20 is configured to connect power from the eyelet terminal 18 to the electric components within the first storage compartment 14. The first connection housing 20 may include a base 22 and a female connector housing 24. The base 22 is configured to house a first bus bar 26. The female connector housing 24 is configured to hold at least one female connector 28.

The junction box assembly 10 further includes a second connection housing 30. The second connection housing 30 is disposed on an undersurface 32 of the second storage compartment 16. As used herein, the undersurface 32 references the bottom of the second storage compartment 16 as oriented in FIG. 4. The second connection housing 30 is configured to hold a second bus bar 34.

A body portion 36 of the second bus bar 34 is mounted within an inner space of the second storage compartment 16. A connecting portion 38 of the second bus bar 34 is disposed within the second connection housing 30, wherein the female connector housing 24 is configured to engage the second connection housing 30 so as to couple the connecting portion 38 of the second bus bar 34 with the female connector 28.

In one embodiment, as shown in FIG. 4, the first storage compartment 14 is a power distribution box (also referenced herein as 14) and the second storage compartment 16 is a bottom housing 16. The power distribution box 14 may include a top cover 15*a*, an intermediate cover 15*b* and a bottom cover 15*c*. The top cover 15*a*, intermediate cover 15*b* and bottom cover 15*c* are releasably coupled together. The power distribution box 14 may be made from a material suitable for use in the injection molding process.

The bottom housing 16 is releasably coupled to the bottom cover 15*c* so as to form a complete junction box assembly 10. The second connection housing 30 is mounted to an undersurface 32 of the bottom cover 15*c*. The first connection housing 20 is mounted within the bottom housing 16. The bottom housing 16 may be releasably coupled to the underside of the power distribution box 14 so as to form a single compartment.

FIG. 4 also shows the connection made between the first connection housing 20 and the second connection housing 30. In particular, the female connector 28 is coupled with the connection portion of the second bus bar 34. The connection is made in the bottom housing 16.

Figure 5:
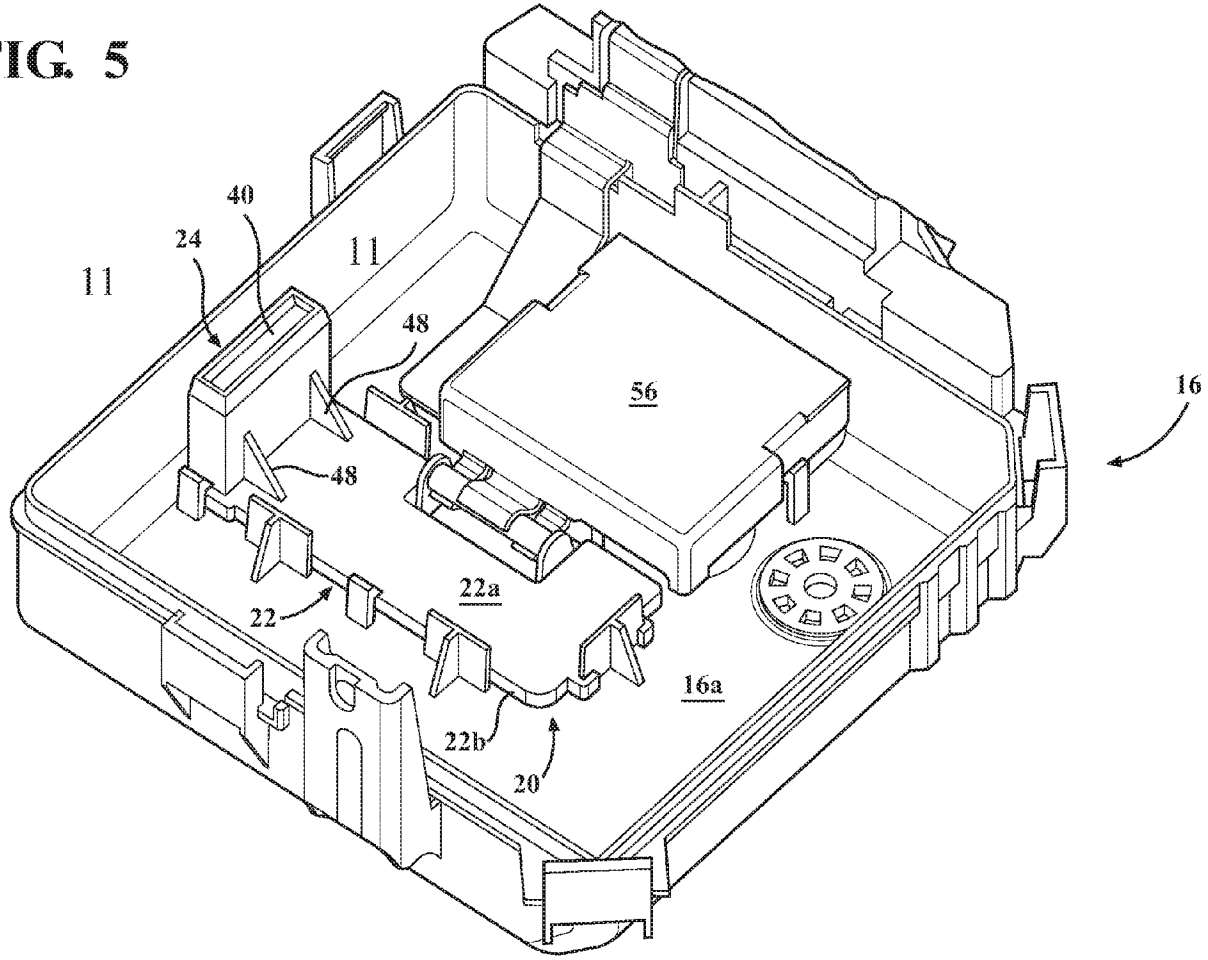
FIG. 5 is an isolated view of a bottom housing according to one or more embodiments described and illustrated herein.

With reference now to FIG. 5, a description of the first connection housing 20 is provided. FIG. 5 provides an embodiment of the base 22. The base 22 is shown as having a generally rectangular shape with a cut out. The shape is provided herein to accommodate packaging space and thus is not limiting to the scope of the appended claims. The base 22 includes a base cover 22*a* and a base side wall 22*b*. The base side wall 22*b* may be a planar member generally bounding the peripheral edge of the base cover 22*a* and generally orthogonal to the base cover 22*a*. The bottom edge of the base side wall 22*b* is mounted to the floor 16*a* of the bottom housing 16 spacing the base cover 22*a* from the floor 16*a* of the bottom housing 16 so as to define a space for accommodating the first bus bar 26.

The female connector housing 24 may be generally cubic having a through-slot 40, wherein the through-slot 40 is open on a proximal end to the space defined by the base 22. The female connector housing 24 and the base 22 may be injection molded as a single piece. The floor 16*a* of the bottom housing 16 may include a plurality of walls configured to engage the base side wall 22*b* so as to fix the base 22 in a predetermined location.

Figure 6:
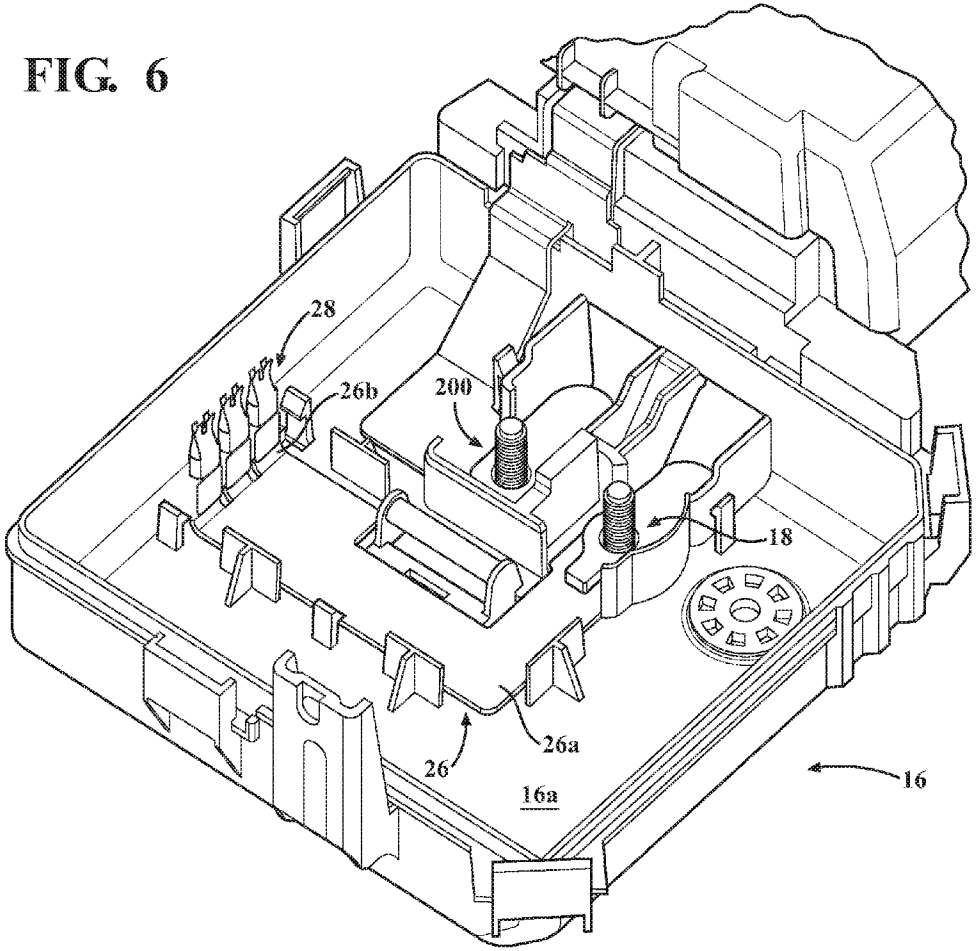
FIG. 6 is a view of FIG. 5 showing the first connection housing and eyelet terminal cover removed.

With reference now to FIG. 6, a view of the bottom housing 16 showing the first bus bar 26 is provided. In one embodiment, the first bus bar 26 includes a base portion 26*a* and a connector portion 26*b*. The base portion 26*a* is disposed within the space defined by the base cover 22*a* and the floor 16*a* and is generally flush against the floor 16*a* of the bottom housing 16. An end of the base portion 26*a* is electrically coupled to the eyelet terminal 18.

The connector portion 26*b* is opposite of the end of the base portion 26*a* electrically coupled to the eyelet terminal 18. The connector portion 26*b* is generally orthogonal to the base portion 26*a*. The connector portion 26*b* is illustratively shown having three female connectors 28. However, it should be appreciated that the junction box assembly 10 may be configured to have a single female connector 28 or more or less than what is shown in FIG. 6. The first bus bar 26 and the second bus bar 34 are formed of an electric conductive material so as to complete an electric connection.

FIG. 6 also provides an embodiment wherein two eyelet terminals 18, 200 are shown. Eyelet terminal 200 may be used to help route power from a power source (not shown) to another junction box or directly to an electronic device. Eyelet terminal 18 is electrically coupled to a power source (not shown), such as a battery for supplying power to the power distribution box 14. The eyelet terminals 18, 200 are illustratively shown as being a threaded stud. The eyelet terminals 18, 200 are partially bound by walls formed on the floor 16*a* of the bottom housing 16.

Figure 7:
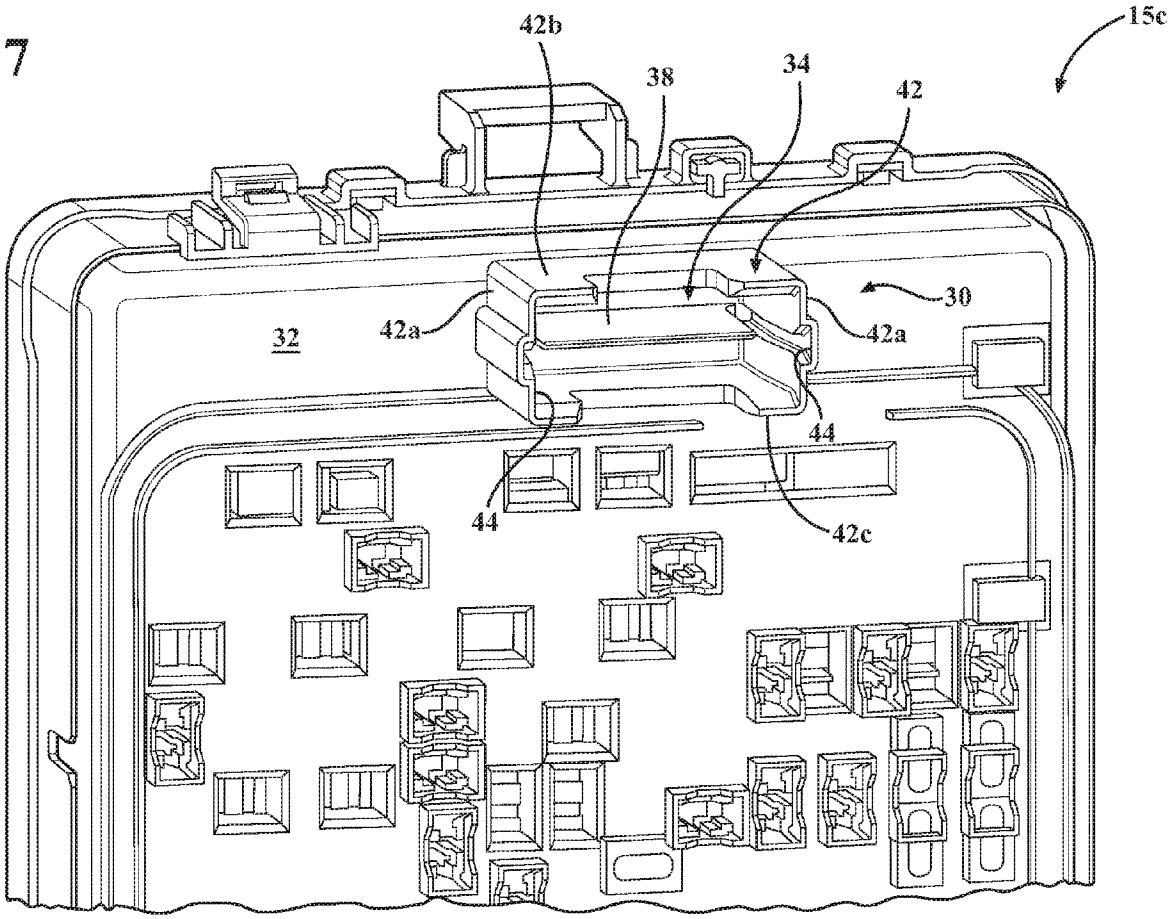
FIG. 7 is an isolated view of the underside surface of a power distribution box according to one or more embodiments described and illustrated herein.

With reference now to FIG. 7, a view of the undersurface 32 of the bottom cover 15*c* of the power distribution box 14 is provided. The bottom cover 15*c* includes a plurality of openings for receiving and holding various electronic components. The second connection housing 30 is shown integrally formed to the undersurface 32 of the bottom cover 15*c*.

The second connection housing 30 includes a peripheral wall 42 disposed on the undersurface 32. The peripheral wall bounds a space configured to seatingly engage the outer surface of the female connector housing 24. The peripheral wall 42 may have a generally rectangular cross-section so as to define a pair of peripheral side walls 42*a*, a peripheral front wall 42*b* and a peripheral back wall 42*c*.

A groove 44 may be formed on at least one of the peripheral side walls 42*a*. In one embodiment, shown herein, the groove 44 is formed on both peripheral side walls 42*a* and are generally opposite each other. The groove 44 extends along the length of the peripheral side wall 42*a* so as to form a raised portion. The raised portion also extends the length of the peripheral side wall 42*a*. The connecting portion 38 of the second bus bar 34 is generally centered within the peripheral wall 42 of the second connection housing 30. The peripheral front wall 42*b* and the peripheral back wall 42*c* are generally symmetrical to each other and each includes a cut out.

With reference now to FIG. 8, an embodiment of the first connection housing 20 in isolation is provided. The base side wall 22*b* may include attachment features for securing the base 22 in position with respect to the bottom housing 16. The first connection housing 20 may further include a rib 48. The rib 48 may be generally triangular, and includes a first rib portion 48*a* and a second rib portion 48*b*. The first rib portion 48*a* is fixed to the female connector housing 24 and the second rib portion 48*b* is fixed to the base 22. It should be appreciated that the rib 48 may be formed as part the first connection housing 20.

The rib 48 provides structural support to help maintain the female connector housing 24 in an upright position. For illustrative purposes, the first connection housing 20 is shown as having three ribs 48, each spaced apart from each other. However, it should be appreciated by those skilled in the art that the number of ribs 48 shown herein is illustrative, and that more or less ribs 48 may be used without limiting the scope of the appended claims.

In one embodiment, the female connector housing 24 includes a fin 50. The fin 50 is disposed on an outer surface of the female connector housing 24. The fin 50 may be a planar member extending along the height of the female connector housing 24. The fin 50 is configured to be seated in the groove 44 so as to help register the first connection housing 20 with the second connection housing 30 when the bottom housing 16 is coupled to the power distribution box 14. In one embodiment, the female connector housing 24 includes a pair of fins 50 on opposite sides of the female connector housing 24.

With reference now to FIG. 9, a view of the through-slot 40 of the female connector housing 24 is shown. The through-slot 40 of the female connector housing 24 defines an inner wall 24*a* configured to accommodate the connecting portion 38 of the second bus bar 34 and the female connector 28 of the first bus bar 26. The through-slot 40 is open on an end to the space defined between the base cover 22*a* and the floor 16*a* of the bottom housing 16. The inner wall 24*a* may further include a guide rib 52. The guide rib 52 is configured to help ensure a positive electric connection. In one embodiment, the inner wall includes a pair of guide ribs 52 extending along the axial length of the through-slot 40 and are opposite of each other.

In another embodiment, as shown herein, the inner wall includes a pair of sets of guide ribs 52. Wherein each set of guide ribs 52 may include two guide ribs 52 extending generally parallel to each other and opposite a corresponding set of guide ribs 52. FIG. 9 shows an embodiment, wherein three sets of guide ribs 52 are provided. However, it should be appreciated that the number of sets of guide ribs 52 are provided herein for illustrative purposes and is not intended to limit the scope of the appended claims.

Figure 10:
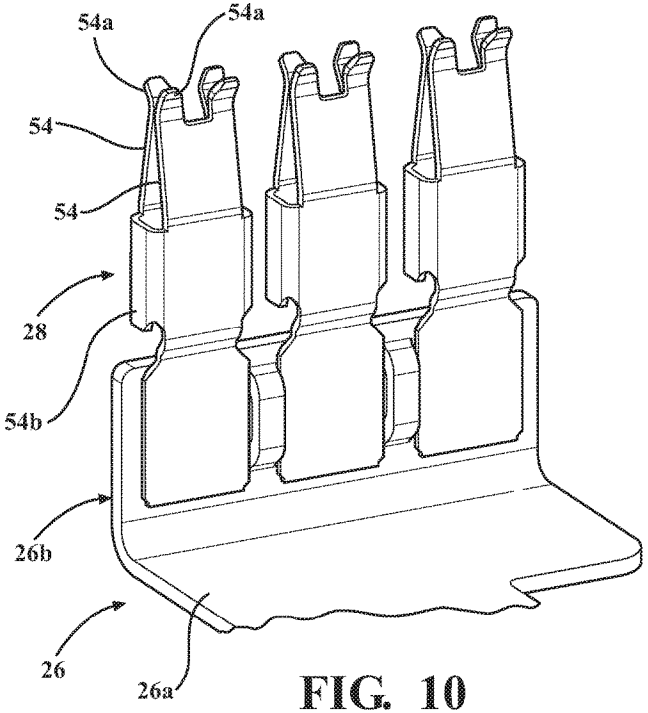
FIG. 10 is a partial view of the first bus bar and the female connector according to one or more embodiments described and illustrated herein.

With reference now to FIG. 10, an illustrative embodiment of a female connector 28 includes a pair of resilient arms 54 spaced apart from each other so as to receive the second bus bar 34. The resilient arms 54 are preferably formed an electric conductive material, such as copper. The female connector 28 is mounted to the connector portion 26*b* of the first bus bar 26 and is configured to receive the second bus bar 34. The arms 54 may be formed on a sleeve portion and are formed so as to touch each other at a distal end of each arm 54. The arms 54 may include a flared end portion 54*a* so as to facilitate the insertion of the connecting portion 38 of the second bus bar 34 between the pair of arms 54. The arms 54 may be integrally formed to the sleeve portion 54*b*. The sleeve portion 54*b* may be mechanically coupled to the connector portion 26*b* of the first bus bar 26 by any means currently known and used in the art, illustratively including spot weld, vibrational weld, frequency weld or a combination thereof.

Figure 11:
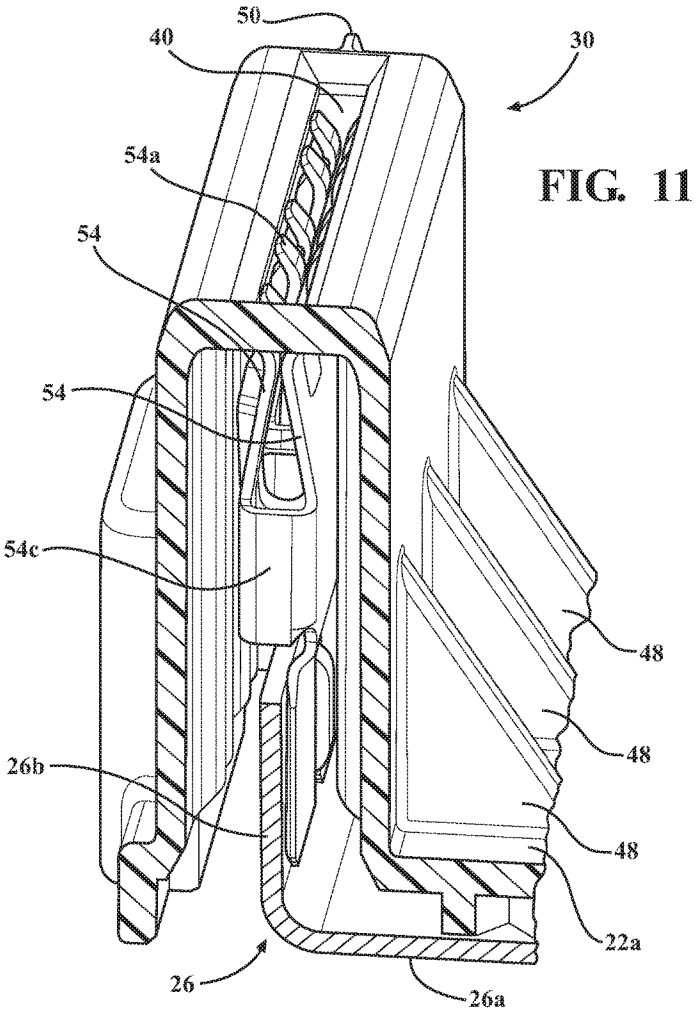
FIG. 11 is a cross-sectional view showing the guide ribs working in concert with the female connector to maintain an electric connection with the second bus bar.

With reference now to FIG. 11, a cross-sectional view of the female connector housing 24 shown in FIG. 5 taken along line 11-11 is provided. The connector portion 26*b* is disposed in the proximal end of the through-slot 40 of the female connector housing 24. The female connector housing 24 is shown configured to hold the arms 54 so as to position the flared portions 54*a* adjacent the opening of the through-slot 40.

Accordingly, the connecting portion 38 of the second bus bar 34 is registered to slide between respective arms 54. The guide ribs 52 are positioned so as to provide a predetermined amount of tolerance between the guide ribs 52 and the arms 54. As the arms 54 are expanded away from each other by the introduction of the connecting portion 38, the arms 54 abut against the guide ribs 52 so as to maintain a predetermined amount of pressure on the connecting portion 38, thus helping to facilitate an electrical connection.

In one embodiment, the junction box assembly 10 further includes an eyelet terminal cover 56 configured to cover and shield the eyelet terminal 18, as shown in FIG. 5. The eyelet terminal cover 56 may be generally a rectangular prism with an open bottom. The eyelet terminal cover 56 may be releasably mounted to the floor 16*a* of the bottom housing 16. In one embodiment, the eyelet terminal cover 56 is hingedly connected to a bar. Attachment structures formed on the floor 16*a* of the bottom housing 16 releasably engages the sidewalls of the eyelet terminal cover 56 in a snap fit engagement to retain the eyelet terminal cover 56.

Figure 1:
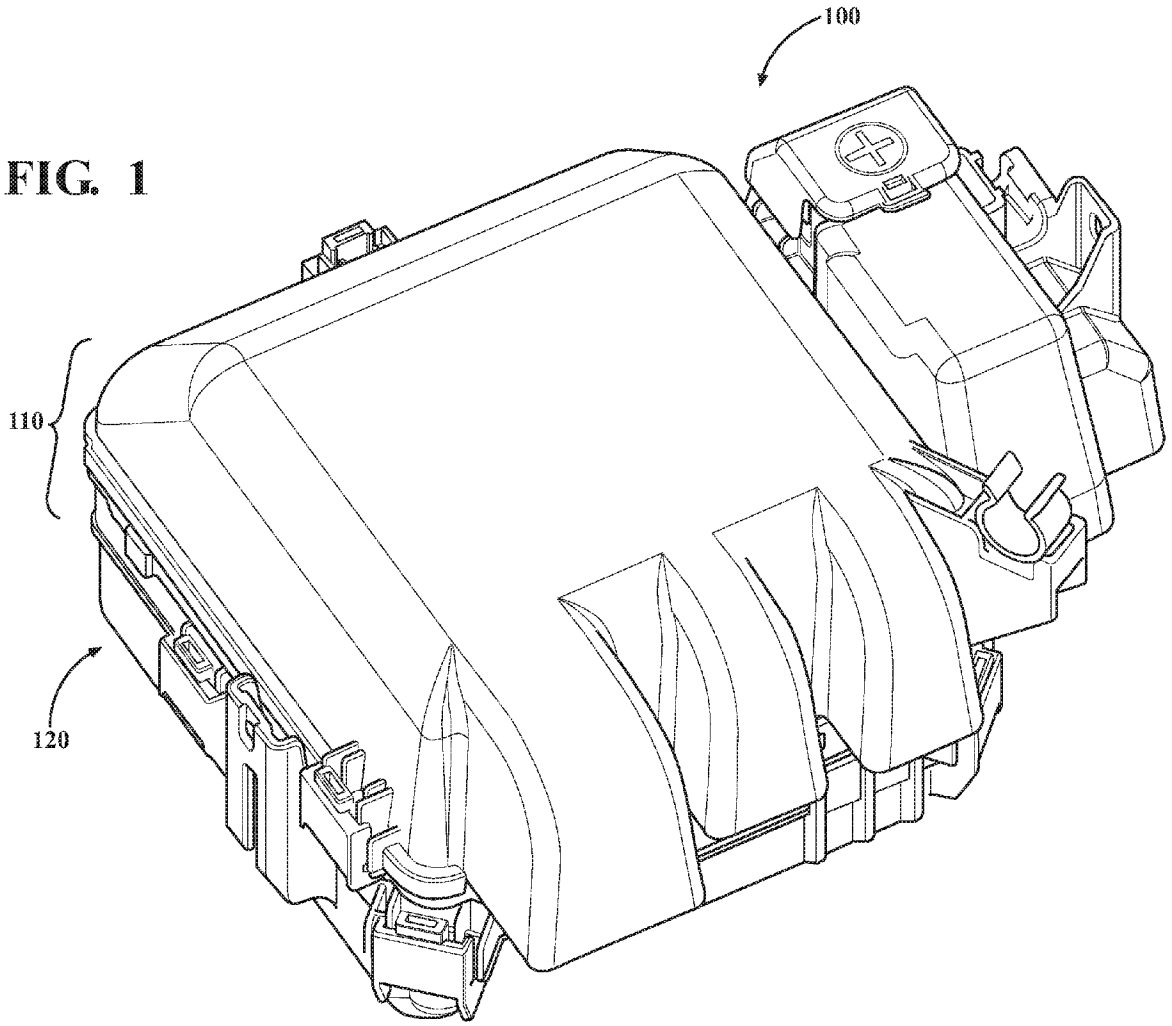
FIG. 1 schematically depicts a prior art junction box assembly.
Figure 2:
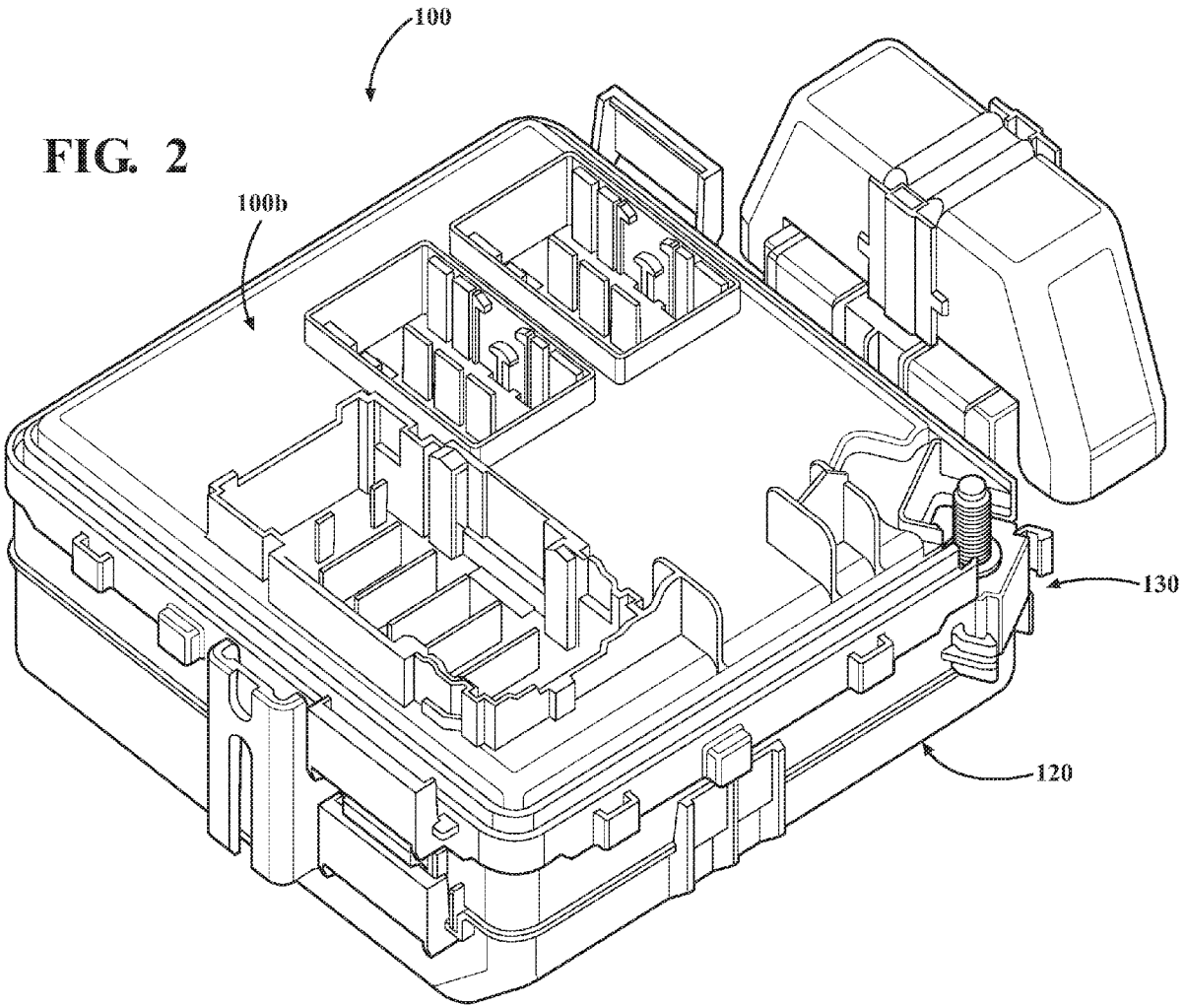
FIG. 2 is a view of FIG. 1 showing the eyelet terminal exposed on an outer side surface of the junction box assembly.
Figure 3:
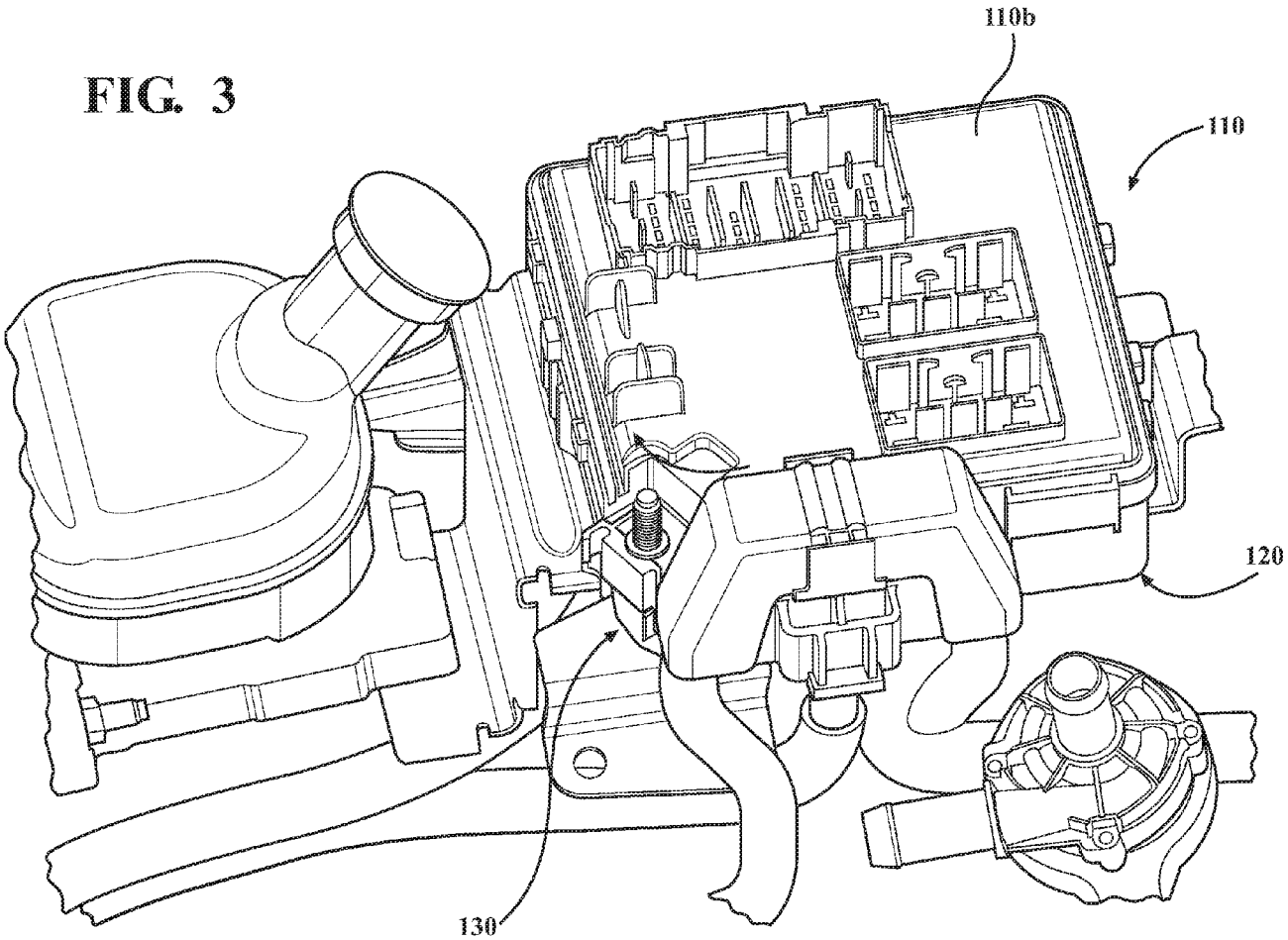
FIG. 3 is a depiction of the junction box assembly shown in FIG. 2 disposed in an exemplary environment.

Accordingly, the junction box is configured to shield the eyelet terminal 18 from the environment so as to prevent damage to the eyelet terminal 18, and help maintain the functional operation of the junction box assembly 10. FIG. 3 shows the prior art construction wherein the eyelet terminal 18 is disposed on the outer surface of the power distribution box. Thus, the eyelet terminal 18 may become damaged by a collision. The junction box assembly 10 illustrated and described herein overcomes such a problem by housing the eyelet terminal 18 within the bottom housing 16. Further, the eyelet terminal 18 is electrically coupled to the power distribution box 14 by a first connection housing 20 engagement with a second connection housing 30.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A junction box assembly comprising:

a housing having a first storage compartment disposed beneath a second storage compartment;

a first connection housing disposed in the first storage compartment, the first connection housing having a base configured to house a first bus bar and a female connector housing configured to hold at least one female connector, wherein the base includes a base cover and a base side wall, the base side wall generally bounding a peripheral edge of the base cover and generally orthogonal to the base cover so as to define a space for accommodating the first bus bar; and a second connection housing disposed on an undersurface of the second storage compartment, wherein a second bus bar is mounted within an inner space of the second storage compartment and a connecting portion of the second bus bar is disposed within the second connection housing, the female connector housing configured to engage the second connection housing so as to couple the connecting portion of the second bus bar with the at least one female connector, wherein the second storage compartment is a power distribution box and wherein the first storage compartment is a bottom housing.

2. The junction box assembly of claim 1, wherein the female connector housing is generally cubic having a through-slot, the through-slot being open on a proximal end to the space defined by the base.

3. The junction box assembly of claim 2, wherein the first bus bar includes a base portion and a connector portion, wherein the base portion is disposed within the space defined by the base, and wherein the connector portion is disposed in the proximal end of the through-slot.

4. The junction box assembly of claim 3, wherein the at least one female connector is mounted to the connector portion.

5. The junction box assembly of claim 2, wherein the first connection housing further includes a rib having a first rib portion and a second rib portion, wherein the first rib portion is fixed to the female connector housing and the second rib portion is fixed to the base.

6. The junction box assembly of claim 2, wherein the through-slot of the female connector housing defines an inner wall, and a guide rib is disposed on the inner wall, the guide rib extending along an axial length of the through-slot.

7. The junction box assembly of claim 6, wherein the at least one female connector includes a pair of resilient arms spaced apart from each other so as to receive the second bus bar, the guide rib limits an expansion of the pair of resilient arms when the second bus bar is seated therein.

8. The junction box assembly of claim 2, wherein the through-slot of the female connector housing defines an inner wall, and a pair of guide ribs are disposed on the inner wall, the pair of guide ribs extending along an axial length of the through-slot and are opposite of each other, wherein the at least one female connector includes a pair of resilient arms spaced apart from each other so as to receive the second bus bar.

9. The junction box assembly of claim 2, wherein the female connector housing includes a fin disposed on an outer surface of the female connector housing.

10. The junction box assembly of claim 9, wherein the second connection housing includes a peripheral wall disposed, the peripheral wall having a pair of peripheral side walls, a peripheral front wall and a peripheral back wall, wherein a groove is disposed on one of the pair of peripheral side walls, the groove configured to receive the fin.

11. A junction box assembly comprising:

a power distribution box and a bottom housing, wherein the power distribution box is configured to house a plurality of electric components directed towards regulating power, the bottom housing configured to mate with an undersurface of the power distribution box;

an eyelet terminal disposed within the bottom housing;

a first connection housing disposed in the bottom housing, the first connection housing having a base configured to house a first bus bar and a female connector housing configured to hold at least one female connector, the first bus bar electrically connected to the eyelet terminal, wherein the base includes a base cover and a base side wall, the base side wall generally bounding a peripheral edge of the base cover and generally orthogonal to the base cover so as to define a space for accommodating the first bus bar; and a second connection housing disposed on an undersurface of the power distribution box, wherein a second bus bar is mounted within an inner space of the power distribution box and a connecting portion of the second bus bar is disposed within the second connection housing, the female connector housing configured to engage the second connection housing so as to couple the connecting portion of the second bus bar with the at least one female connector.

12. The junction box assembly of claim 11, wherein the female connector housing is generally cubic having a through-slot, the through-slot being open on a proximal end to the space defined by the base.

13. The junction box assembly of claim 12, wherein the first bus bar includes a base portion and a connector portion, wherein the base portion is disposed within the space defined by the base, and wherein the connector portion is disposed in the proximal end of the through-slot, wherein the at least one female connector is mounted to the connector portion.

14. The junction box assembly of claim 13, wherein the first connection housing further includes a rib having a first rib portion and a second rib portion, wherein the first rib portion is fixed to the female connector housing and the second rib portion is fixed to the base.

15. The junction box assembly of claim 13, wherein the through-slot of the female connector housing defines an inner wall, and a guide rib is disposed on the inner wall, the guide rib extending along an axial length of the through-slot, and wherein the at least one female connector includes a pair of resilient arms spaced apart from each other so as to receive the second bus bar, the guide rib limits an expansion of the pair of resilient arms when the second bus bar is seated therein.

16. The junction box assembly of claim 13, wherein the female connector housing includes a fin disposed on an outer surface of the female connector housing, and wherein the second connection housing includes a peripheral wall disposed, the peripheral wall having a pair of peripheral side walls, a peripheral front wall and a peripheral back wall, wherein a groove is disposed on one of the pair of peripheral side walls, the groove configured to receive the fin.

17. The junction box assembly of claim 11, further including an eyelet terminal cover configured to cover and shield the eyelet terminal.

* * * * *